US009248647B2

(12) United States Patent
Iwanaga et al.

(10) Patent No.: US 9,248,647 B2
(45) Date of Patent: Feb. 2, 2016

(54) LIQUID EJECTION HEAD IN WHICH POSITIONAL RELATIONSHIPS OF ELEMENTS ARE NOT AFFECTED BY CURING OF BONDING ADHESIVE

(71) Applicant: CANON KABUSHIKI KAISHA, Tokyo (JP)

(72) Inventors: Shuzo Iwanaga, Kawasaki (JP); Zentaro Tamenaga, Sagamihara (JP); Kazuhiro Yamada, Yokohama (JP); Takuto Moriguchi, Kamakura (JP); Takatsugu Moriya, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/326,573

(22) Filed: Jul. 9, 2014

(65) Prior Publication Data

US 2015/0029265 A1 Jan. 29, 2015

(30) Foreign Application Priority Data

Jul. 24, 2013 (JP) ..... 2013-153811

(51) Int. Cl.

| | |
|---|---|
| ***B41J 2/14*** | (2006.01) |
| ***B41J 2/16*** | (2006.01) |
| ***B41J 2/155*** | (2006.01) |

(52) U.S. Cl.

CPC ..... *B41J 2/14024* (2013.01); *B41J 2/155* (2013.01); *B41J 2/1623* (2013.01); *B41J 2202/19* (2013.01); *B41J 2202/20* (2013.01)

(58) Field of Classification Search

CPC .. B41J 2/14072; B41J 2/14024; B41J 2/1623; B41J 2002/14491

See application file for complete search history.

(56) References Cited

U.S. PATENT DOCUMENTS

| | | | | |
|---|---|---|---|---|
| 7,475,964 | B2 * | 1/2009 | Benson et al. | 347/50 |
| 7,775,638 | B2 | 8/2010 | Hirosawa et al. | |
| 7,789,499 | B2 | 9/2010 | Iwanaga et al. | |
| 7,980,676 | B2 | 7/2011 | Hirosawa et al. | |

(Continued)

FOREIGN PATENT DOCUMENTS

| | | | |
|---|---|---|---|
| CN | 102069641 | A | 5/2011 |
| CN | 103171284 | A | 6/2013 |

(Continued)

OTHER PUBLICATIONS

Office Action in Chinese Patent Application No. 201410356125.8, dated Aug. 24, 2015.

*Primary Examiner* — Juanita D Jackson

(74) *Attorney, Agent, or Firm* — Fitzpatrick, Cella, Harper & Scinto

(57) ABSTRACT

A liquid ejection head includes an electrical wiring substrate and a printing element substrate, wherein the position variation of the printing element substrate due to curing of a sealing agent is eliminated. Specifically, a gap between two support members is covered with the electrical wiring substrate so as to be able to prevent a sealing agent from flowing into the gap. As a result, even in the case where the size of the gap varies due to the variation in the dimensional accuracy and/or the variation in the assembly accuracy, the sealing agent will not enter this gap, and therefore the shape thereof can be made substantially uniform regardless of the positions. This results in a substantially uniform stress in curing and contracting of the sealing agent, and the variation in the mounting position of the printing element substrate can be suppressed.

14 Claims, 10 Drawing Sheets

(56) References Cited

U.S. PATENT DOCUMENTS

| | | | |
|---|---|---|---|
| 8,398,211 | B2 | 3/2013 | Shimamura |
| 8,454,129 | B2 | 6/2013 | Kanda et al. |
| 8,550,599 | B2 | 10/2013 | Miyazaki et al. |
| 8,678,556 | B2 | 3/2014 | Iwanaga et al. |
| 2005/0162466 | A1 | 7/2005 | Silverbrook et al. |
| 2006/0027937 | A1 | 2/2006 | Benson et al. |

FOREIGN PATENT DOCUMENTS

| | | | |
|---|---|---|---|
| JP | 2010-023491 | A | 2/2010 |
| JP | 2010-284813 | A | 12/2010 |
| JP | 4757011 | B2 | 8/2011 |

* cited by examiner

LIQUID EJECTION HEAD IN WHICH POSITIONAL RELATIONSHIPS OF ELEMENTS ARE NOT AFFECTED BY CURING OF BONDING ADHESIVE

BACKGROUND OF THE INVENTION

1. Field of the Invention

The present invention relates to liquid ejection heads and liquid ejection apparatuses, and more specifically, relates to a parts arrangement in an electrical wiring substrate for supplying an electric signal to a printing element substrate for ejecting liquid, such as ink, in the liquid ejection head.

2. Description of the Related Art

In the liquid ejection head, an electrothermal conversion element is used as a printing element that generates energy for ejecting liquid. The electrical wiring substrate for supplying an electric signal to this electrothermal conversion element is provided corresponding to the printing element substrate having the electrothermal conversion elements arranged therein.

Japanese Patent No. 4757011 describes a long line-type liquid ejection head including a plurality of printing element substrates arranged on a support substrate. In this liquid ejection head, the plurality of printing element substrates is arranged in a staggered form along the direction of arranging their ejection ports. In the electrical wiring substrate used here, a single electrical wiring substrate has respective openings for incorporating the plurality of printing element substrates. Moreover, US Patent Laid-Open No. 2005/0162466 describes a liquid ejection head including a plurality of head modules mounted on a support member. In the individual head module, a printing element substrate is mounted on a flow path member and an individual electrical wiring substrate is provided around the printing element substrate.

However, the arrangements of the electrical wiring substrate described in Japanese Patent No. 4757011 and US Patent Laid-Open No. 2005/0162466 have a problem that particularly the position of the printing element substrate may deviate from a desired position due to a sealing member for sealing an electrical connecting portion between the electrical wiring substrate and the printing element substrate.

Specifically, in manufacturing the liquid ejection head, first, the printing element substrate and the electrical wiring substrate are bonded and fixed onto the support member, and these substrates are electrically connected to each other by using wires. Then, a sealing agent is applied to this connecting portion and the resulting portion is heated to cure the sealing agent. Furthermore, after curing the sealing agent, the liquid ejection head is taken out from a heating furnace and cooled. The electrical wiring substrate expands and contracts due to heating and cooling for curing the sealing agent in such a manufacturing process. That is, during heating, the sealing agent is cured in the state where the electrical wiring substrate extends, and the electrical wiring substrate will contract due to the subsequent cooling. In this process, the support member and the printing element substrate experience the stresses of extension and compression and thereby the position of the printing element substrate may vary. Such a liquid ejection head including the printing element substrate whose position has deviated might cause a problem, for example, that the printing image quality degrades.

SUMMARY OF THE INVENTION

An object of the present invention is to provide a liquid ejection head including a parts arrangement in an electrical wiring substrate which does not cause a position variation of a printing element substrate due to curing of a sealing agent and to provide a liquid ejection apparatus using the head.

In a first aspect of the present invention, there is provided a liquid ejection head comprising: a printing element substrate on which an ejection port for ejecting liquid is provided; a support member supporting the printing element substrate; other member arranged to be separated from the support member by a gap; an electrical wiring substrate that is provided to be extended over the support member and the other member and covers the gap; and an electrical connecting portion electrically connecting with the printing element substrate, wherein the electrical connecting portion is sealed with a sealing agent.

According to the above-described configuration, in the liquid ejection head, the electrical wiring substrate is arranged so as to be extended over a space between a support member and other members and cover the gap therebetween. This enables to prevent the position of the printing element substrate from varying due to a stress caused by the sealing agent entering this gap and being cured.

Further features of the present invention will become apparent from the following description of exemplary embodiments (with reference to the attached drawings).

DESCRIPTION OF THE EMBODIMENTS

Hereinafter, the embodiments of the present invention will be described in detail with reference to the accompanying drawings.

First Embodiment

Figure 1:
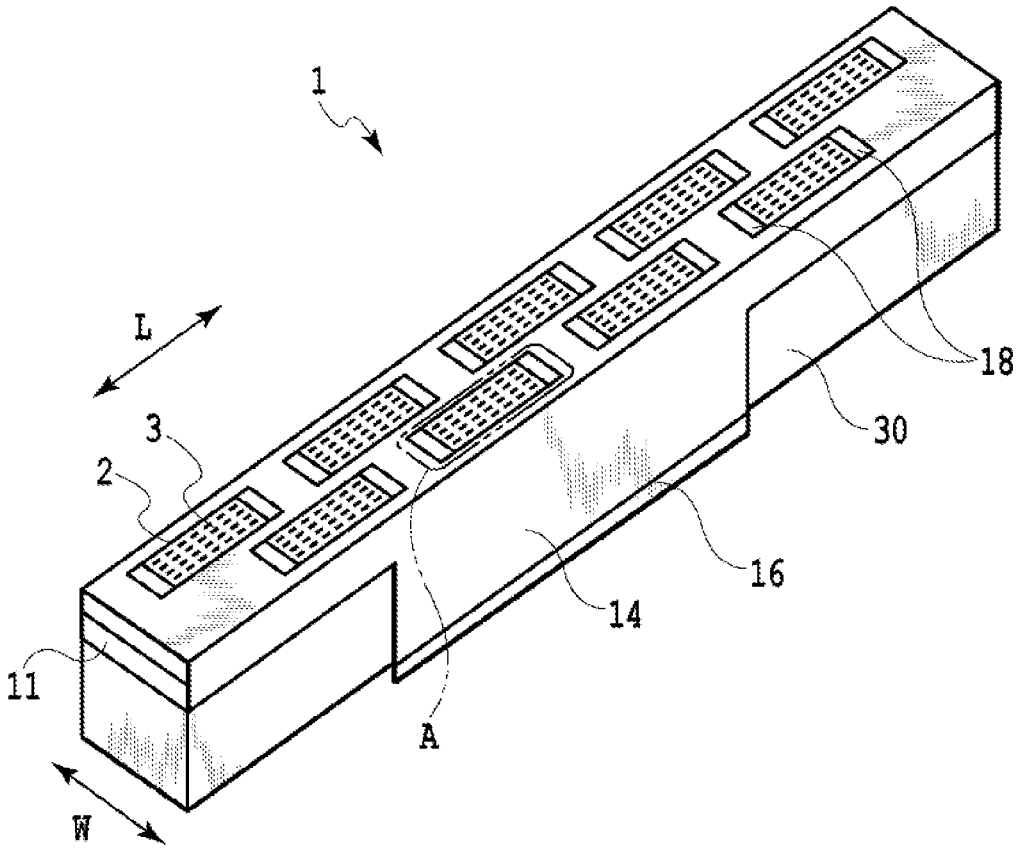
FIG. 1 is a schematic perspective view illustrating a liquid ejection head according to a first embodiment of the present invention.
Figure 2:
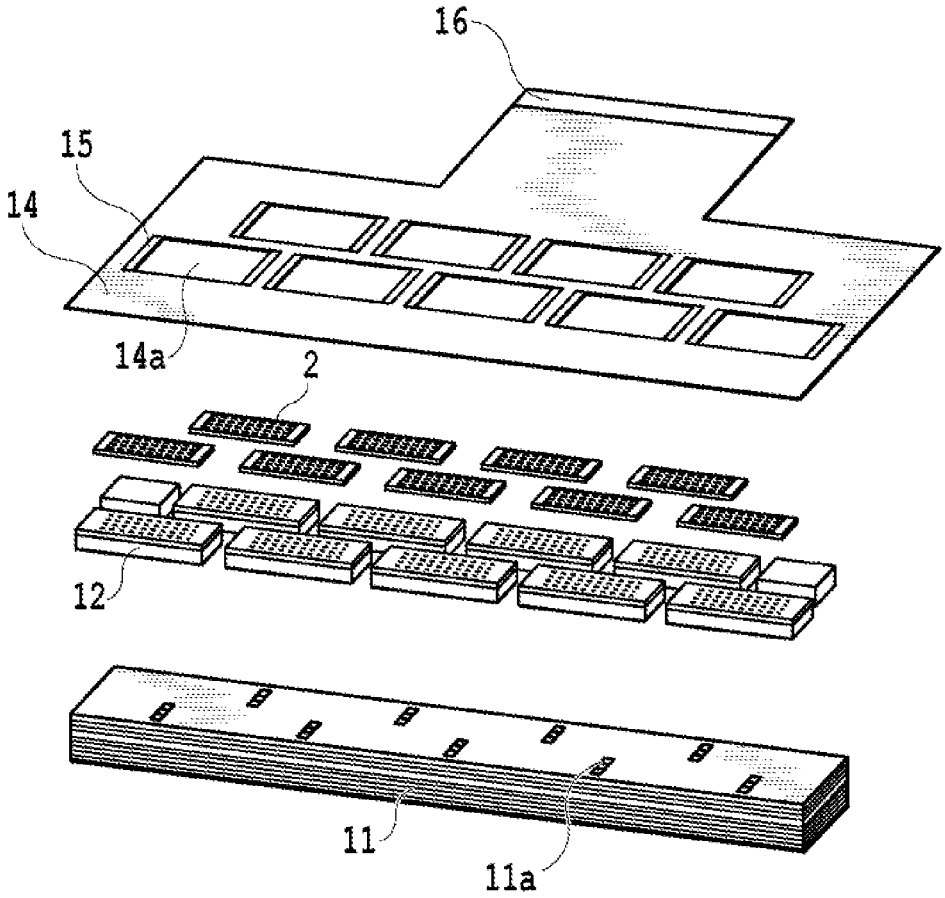
FIG. 2 is an exploded perspective view of a portion excluding a liquid supply member of the liquid ejection head illustrated in FIG. 1.

FIG. 1 is a schematic perspective view illustrating a liquid ejection head according to a first embodiment of the present invention, and FIG. 2 is an exploded perspective view of the portion excluding a liquid supply member of the liquid ejection head illustrated in FIG. 1. As illustrated in FIG. 1 and FIG. 2, a liquid ejection head 1 of the embodiment includes a printing element substrate 2, a support substrate 11, a support member 12, an electrical wiring substrate 14, and a liquid supply member 30.

In the printing element substrate 2, there are provided an ejection port for ejecting liquid, such as ink, and an electrothermal conversion element that generates energy for ejection, the electrothermal conversion element corresponding to this ejection port. The ejection port and the electrothermal conversion element constitute the printing element. A plurality of ejection ports provided in the printing element substrate 2 constitutes an ejection port array 3. On the support substrate 11, a plurality of support members 12 is arranged in a staggered form, and further on each of the support members 12, one of the printing element substrates 2 is arranged. A liquid flow path (not shown) is formed inside the support substrate 11 and communicates with a liquid inlet port 11*a*. The liquid inlet port 11*a* is further connected to a flow path inside the support member 12 whereby liquid is introduced into the printing element substrate 2.

The electrical wiring substrate 14 is provided in order to supply an external electric signal to the printing element substrate. In this embodiment, a flexible film wiring substrate (FPC) having flexibility is used for the electrical wiring substrate 14. The electrical wiring substrate 14 is supported and fixed by the support member 12, and also includes a plurality of openings 14*a* and is arranged so that the printing element substrates 2 are positioned inside these openings 14*a*, respectively. The liquid supply member 30 includes a liquid supply chamber for supplying liquid to the printing element substrate 2 via the support substrate 11 and the support member 12.

A long line-type liquid ejection head is constituted by arranging a plurality of printing element substrates 2, and ejection ports are arranged corresponding to the full width of a printing medium to be used. In this embodiment, nine printing element substrates 2 are arranged to constitute the liquid ejection head 1 having a printing width of approximately 6 inches as a whole. By increasing the number of the printing element substrates 2, the printing width can be further increased and a liquid ejection head having the printing width exceeding 12 inches can be also constituted.

As illustrated in FIG. 1 and FIG. 2, the support member 12 is provided corresponding to the individual printing element substrate. Thus, in the case where a defect is found in a certain printing element substrate 2, the printing element substrate can be replaced for each support member. Moreover, by precisely arranging each support member 12 on the support substrate, the positional accuracy of the supply port formed in the support member 12 can be also ensured. For the quality of the material of the support substrate 11, the material preferably has a low linear expansion coefficient, a high rigidity, and corrosion resistance against ink, and for example, aluminum oxide, silicon carbide, or the like can be suitably used therefor. For the quality of the material of the support member 12, the material preferably has corrosion resistance against ink. Specifically, the same material as the material of the support substrate 11 may be also used. Moreover, a resin material, particularly PPS (polyphenylene sulfide), modified PPE, or the like used as a base material, added by a proper amount of inorganic fillers, such as silica particles, can be suitably used. Although use of the resin material is advantageous in terms of component cost, the linear expansion coefficient thereof is usually higher as compared with the printing element substrate 2 or the support substrate 11. The linear expansion coefficient can be reduced to some extent by adding fillers, but in the case where a large amount of fillers is filled, the moldability decreases and the geometry of a heat insulation member cannot be maintained. Accordingly, there is a limit to the additive amount of fillers and there is a limit to the reduction of the linear expansion coefficient. If there is a difference in the linear expansion coefficient between the support member 12 and the printing element substrate 2 or support substrate 11, then in the case where the head temperature increases, peeling-off might occur in an interface between the support member 12 and the printing element substrate 2 or support substrate 11. This problem can be solved by dividing the support member 12 of the embodiment to reduce the dimensions thereof and thereby reducing the stress and suppressing the peeling-off force.

Figure 3A:
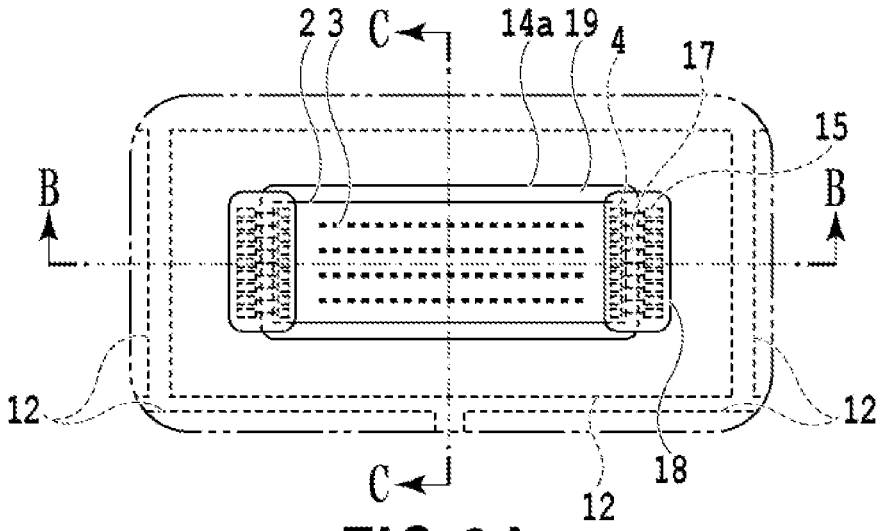
FIGS. 3A to 3C are views illustrating the details of the configuration in the vicinity of one printing element substrate in the liquid ejection head of the embodiment.
Figure 3B:
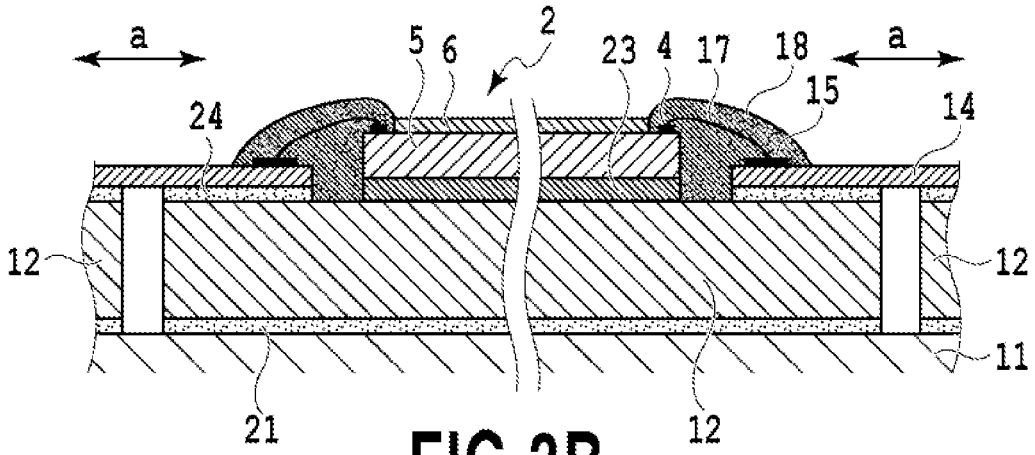
Figure 3C:
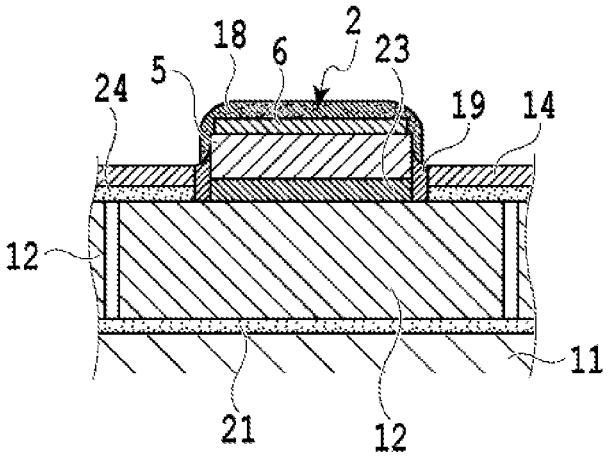

FIGS. 3A to 3C are the views illustrating the details of the configuration in the vicinity of one printing element substrate in the liquid ejection head of the embodiment. Specifically, FIG. 3A is a plan view enlarging and illustrating the vicinity of the printing element substrate in a portion A of FIG. 1. FIG. 3B is the schematic cross sectional view along a B-B line of FIG. 3A. FIG. 3C is the schematic cross sectional view along a C-C line of FIG. 3A. The printing element substrate 2 includes a silicon substrate 5 having a thickness from 0.5 to 1.0 mm, for example and a nozzle plate 6. In the silicon substrate 5, a liquid supply port (not shown) including a long groove-like through-hole is formed as the liquid flow path. In the silicon substrate 5, an electrothermal conversion element, which is the printing element, and electric wirings including aluminum (Al) are formed, for example, and an electrode 4 electrically connected to the electric wirings is formed at the both ends of the silicon substrate 5. A non-illustrated foaming chamber is formed in the nozzle plate 6. The foaming chamber communicates with the liquid supply port of the silicon substrate 5. In the nozzle plate 6, the ejection ports are formed corresponding to the electro thermal conversion elements so that an ejection port array 3 is formed.

As illustrated in FIGS. 3B and 3C, the support member 12 is arranged on the support substrate 11. These support substrate 11 and support member 12 are bonded and fixed to each other with an adhesive agent 21. Furthermore, onto the support member 12, the printing element substrate 2 is bonded and fixed with an adhesive agent 23. The electrical wiring substrate 14 is arranged so as to be extended over a space between a plurality of support members 12 at substantially the same height relative to this printing element substrate, and is bonded and fixed to the support member 12 with an adhesive agent 24. Thus, the gap between the plurality of support members 12 is covered with the electrical wiring substrate 14. This prevents, as described later, the sealing material used in the manufacturing process from entering this gap. As a result, the positional deviation of the printing element substrate along with curing of the sealing material can be prevented.

The electrode 4 of the printing element substrate 2 and an electrode terminal 15 of the electrical wiring substrate 14 are electrically connected to each other with a conductive wire 17, so that an electric signal from a non-illustrated printing apparatus body can be transferred to the printing element substrate 2 via the electrical wiring substrate 14. In the embodiment, the bonding portion between the electrode terminal 15 and the wire 17 is positioned above the support member 12, i.e., on the opposite side of the above-described gap with respect to the electrical wiring substrate 14. The electrical connecting portion including the electrode 4, the electrode terminal 15, and the wire 17 is sealed with a first sealing agent 18. The first sealing agent 18 includes a material having a high modulus of elasticity, mechanically protects the electrical connecting portion, and also protects from the corrosion caused by liquid. The outer periphery of the printing element substrate 2 is sealed with a sealing agent 19, thereby improving sealing characteristic between the printing element substrate 2 and the support member 12 and preventing the liquid from leaking due to an unexpected accident.

According to the above embodiment, the gap between adjacent support members 12 is covered with the electrical wiring substrate 14, thereby preventing the first sealing agent 18 from flowing into this gap. As a result, even in the case where the size of the gap varies due to the variation in the component dimensional accuracy and/or the variation in the assembly accuracy, the first sealing agent 18 will not enter this gap, and therefore the geometries thereof can be made substantially uniform regardless of the positions. This results in a substantially uniform stress in curing and contracting of the first sealing agent 18, so that the variation in the mounting position of the printing element substrate 2 can be suppressed.

Figure 4:
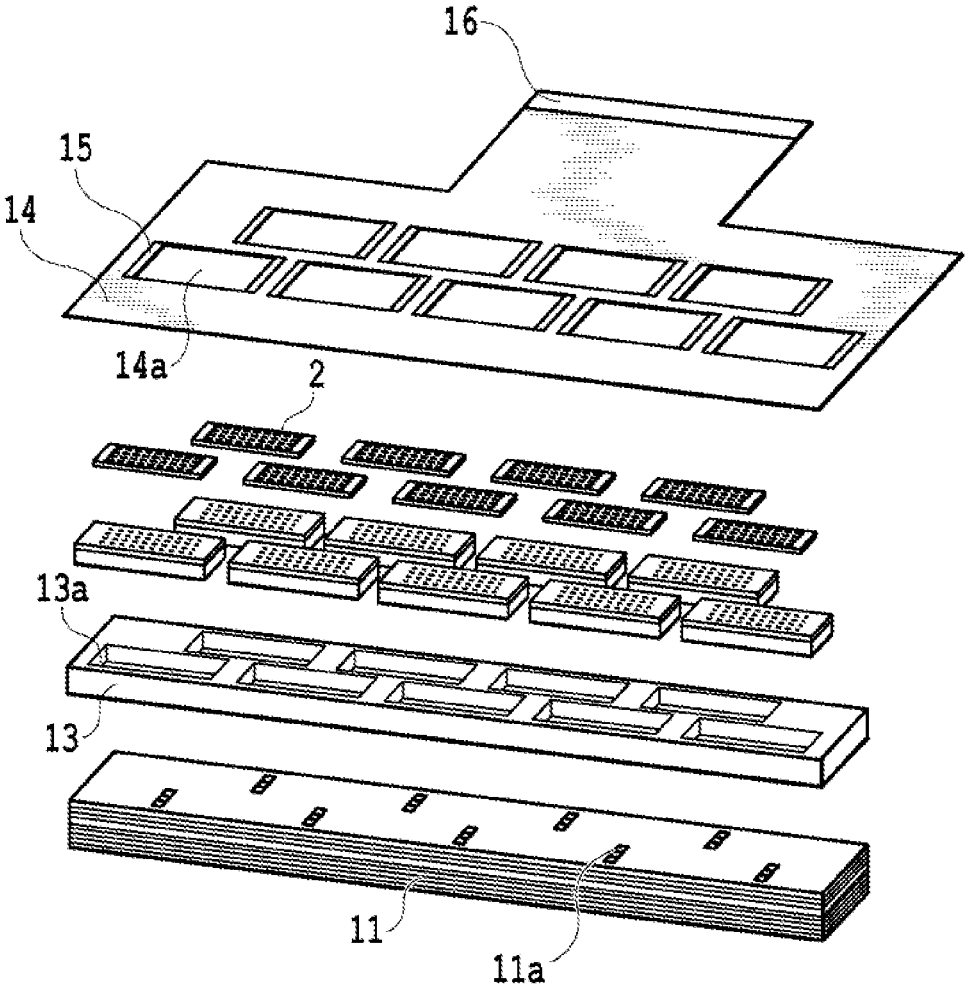
FIG. 4 is an exploded perspective view of a liquid ejection head according to a modification of the first embodiment.
Figure 5A:
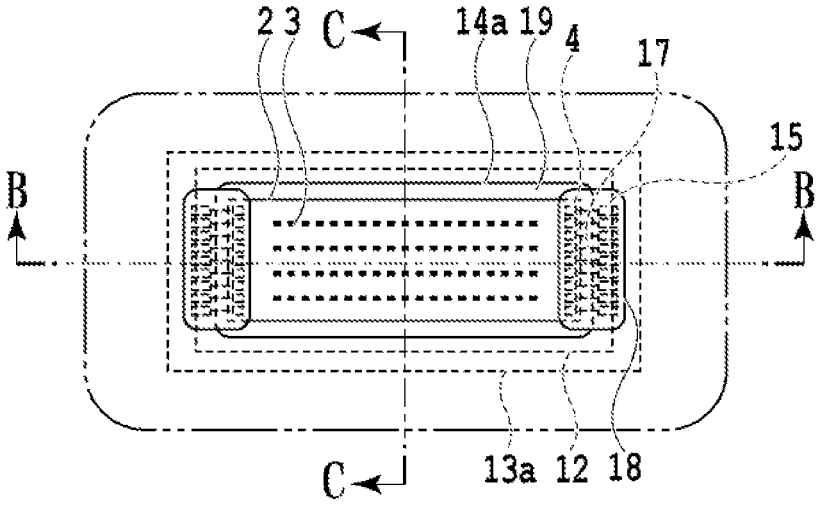
FIGS. 5A to 5C are views illustrating the details of the configuration in the vicinity of one printing element substrate in the liquid ejection head of the modification.
Figure 5B:
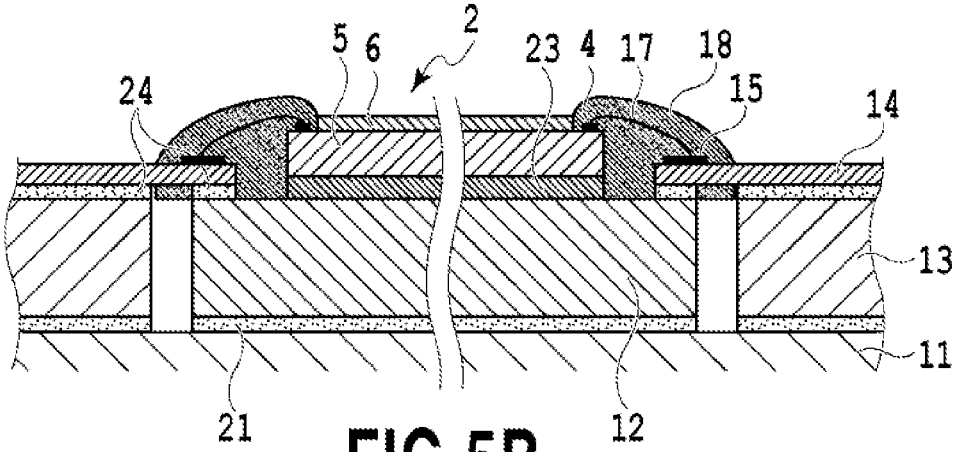
Figure 5C:
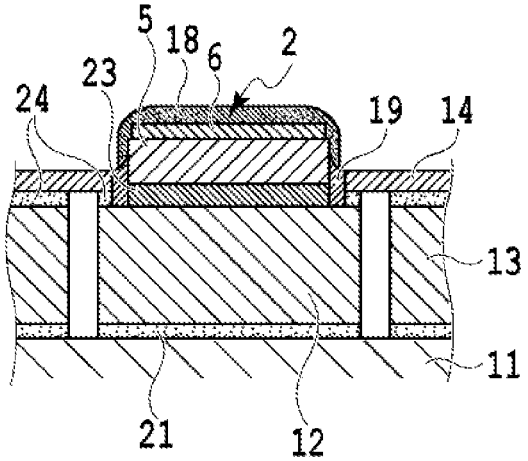

FIG. 4 is an exploded perspective view of the liquid ejection head according to a modification of the above-described first embodiment. FIGS. 5A to 5C are the views illustrating the details of the configuration in the vicinity of one printing element substrate in the liquid ejection head of the modification.

As illustrated in FIG. 4, a frame member 13 is supported and fixed on the support substrate 11. The frame member 13 includes a plurality of openings 13*a*, and the support member 12 is arranged inside the opening 13*a*. As illustrated in FIGS. 5B and 5C, the support member 12 and the frame member 13 are arranged on the support substrate 11. The support substrate 11 and the support member 12 are bonded and fixed to each other with the adhesive agent 21, and the support substrate 11 and the frame member 13 are bonded and fixed to each other with the adhesive agent 21. The height of the support member 12 and the height of the frame member 13 relative to the support substrate 11 are substantially the same after bonding.

The electrical wiring substrate 14 is arranged so as to be extended over a space between the frame member 13 and support member 12 that are set at substantially the same height, and is bonded and fixed to the respective members with the adhesive agent 24. Thus, the gap between the frame member 13 and the support member 12 is covered with the electrical wiring substrate 14 to form a sealed space. Most part of the electrical wiring substrate 14 is bonded and fixed to the frame member 13, and only a part thereof is bonded and fixed onto the heat insulation member. Moreover, in the modification, the whole outer peripheries of the openings 14*a* are arranged on the support member. For the quality of the material of the frame member, a material having a high rigidity and also having a linear expansion coefficient lower than the electrical wiring substrate is preferably used. For example, aluminum oxide or the like is suitably used.

Also in the modification, the electrical wiring substrate 14 is arranged so as to be extended over a space between the frame member 13 and the support member 12, so that a similar effect on the positional accuracy in arrangement of the printing element substrate can be obtained.

In the manufacturing process of the liquid ejection head, as described above, the electrical wiring substrate expands and contracts due to heating and cooling for curing the sealing agent. That is, during heating, the sealing agent is cured in the state where the electrical wiring substrate extends, and the electrical wiring substrate will contract due to the subsequent cooling. However, in this case, the support member and the printing element substrate experience an extension force and a compression force and thereby the position of the printing element substrate may vary.

Such a position variation is significant particularly in the case where the modulus of elasticity of an adhesive agent for bonding the support member is low or in the case where a resin material is used for the support member. In the case where the electrical wiring substrate is a flexible wiring substrate, the linear expansion coefficient is approximately $16\times10^{-6}$ (1/K). Moreover, in the case where a material made by mixing fillers into a resin is used for the support member, the linear expansion coefficient is approximately 15 to $40\times10^{-6}$ (1/K). When an experiment is conducted using a liquid ejection head whose printing width is approximately 6 inches (eight printing element substrates are used), the variation in the mounting position of each printing element substrate before and after curing the sealing agent is approximately 6 μm at the maximum in the direction of arrangement of the ejection ports (in the longitudinal direction of the printing element substrate). Note that, in the experiment, the support member 12 having the linear expansion coefficient of $15\times10^{-6}$ (1/K) is used.

The present inventors studied using a liquid ejection head of a comparative example illustrated in FIGS. 10A to 10E, in order to suppress the expansion and contraction of the electrical wiring substrate 14. FIGS. 10A to 10E are the views illustrating the configuration of the liquid ejection head according to the comparative example. In the comparative example illustrated in FIGS. 10A to 10E, although the frame member 13 is provided, the electrical wiring substrate 14 is arranged only on the frame member 13 and bonded and fixed thereto. In order to suppress the expansion and contraction of the electrical wiring substrate 14, a material whose linear expansion is lower than the electrical wiring substrate 14 is used for the frame member 13. In the experiment, aluminum oxide whose linear expansion coefficient is approximately $7\times10^{-6}$ (1/K) was used. When the variation in the mounting position of the printing element substrate before and after curing the sealing agent was measured, an improvement tendency was observed also in the comparative example, but some individual printing element substrates of the comparative example had large variation values.

Figure 10A:
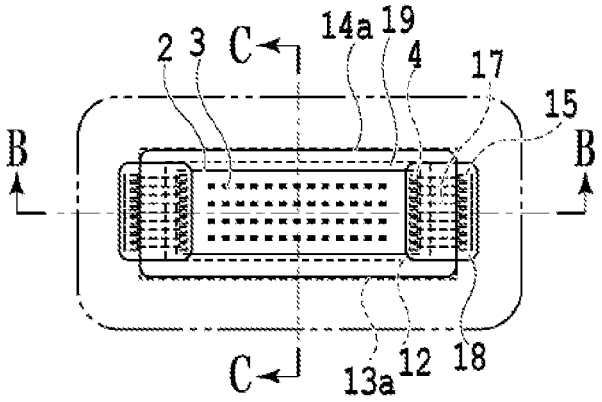
FIGS. 10A to 10E are views illustrating the configuration of a liquid ejection head according to a comparative example of the embodiment of the present invention.
Figure 10B:
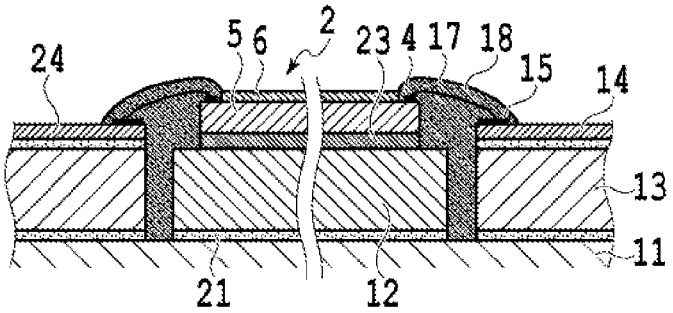
Figure 10C:
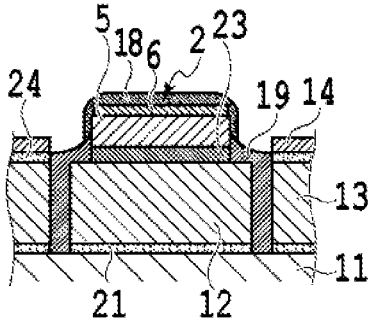
Figure 10D:
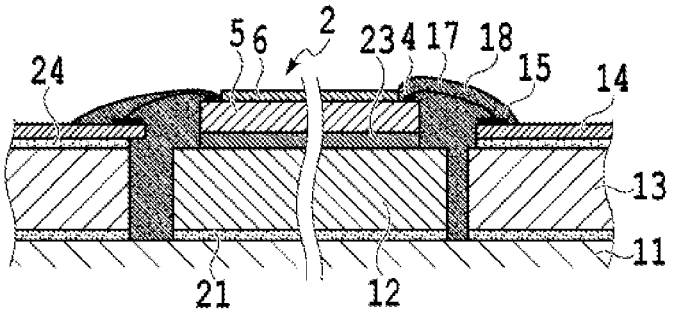
Figure 10E:
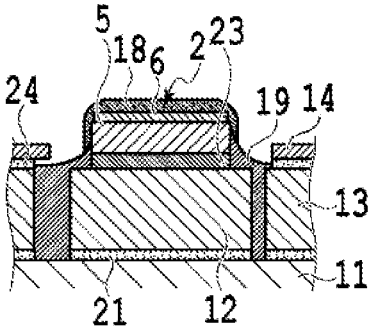

In some individual printing element substrates of the comparative example, due to the variation in the dimensional accuracy of a component of the liquid ejection head or the variation in assembly accuracy in the manufacturing process, the size of the gap between the frame member 13 and the support member 12 may vary on both sides of the support member 12 as illustrated in FIG. 10D. As a result, a liquid ejection head is manufactured in which the shape of the sealing agent 18 differs on both sides of the support member 12. In such a case, it is believed that the curing contraction stress when the sealing agent is cured also varies on both sides of the support member 12, and thus the forces which the printing element substrate 2 receives from both sides become uneven and the position variation occurs. Moreover, as another problem, variations in height of the sealing agent 18 occur depending on the difference in the size of the gap, so that a failure due to exposure of a wire like the sealing agent on the left side may occur or a failure due to an increase of the height of the sealing agent like the sealing agent on the right side may occur. When the sealing height increases, an interference with the printing medium is likely to occur. In order to prevent this, the distance between the printing medium and the head needs to be increased, thus leading to a problem that the landing position accuracy of ejection liquid droplets degrades and the image quality degrades.

The configuration illustrated in FIG. 4 and FIG. 5 according to the modification can, as with the embodiment illustrated in FIGS. 3A to 3C, solve the above-described problem in the comparative example. That is, the gap between the frame member 13 and the support member 12 is covered with the electrical wiring substrate 14 and forms an enclosed space to be able to prevent the sealing agent 18 from flowing into this gap. As a result, even in the case where the size of the gap varies due to the variation in the component dimensional accuracy and/or the variation in the assembly accuracy, the sealing agent 18 will not be formed in this gap and the shape thereof can be made substantially uniform regardless of the positions. This results in a substantially uniform stress in curing and contracting of the sealing agent 18, so that the variation in the mounting position of the printing element substrate 2 can be suppressed and the variation in sealing height can be also suppressed.

Moreover, because most part of the electrical wiring substrates 14 is bonded and fixed to the frame member 13, the expansion and contraction of the electrical wiring substrate 14 due to heating and cooling during the manufacturing processes can be suppressed, and the variation in the mounting position of the printing element substrate via the first sealing agent 18 can be suppressed.

In the embodiment, as a result of having conducted the same experiment as the above-described comparative example, the variation in the mounting position of the printing element substrate before and after curing the sealing agent was improved to 3 μm or less in the direction of arrangement of the ejection ports (in the longitudinal direction of the printing element substrate).

Figure 6A:
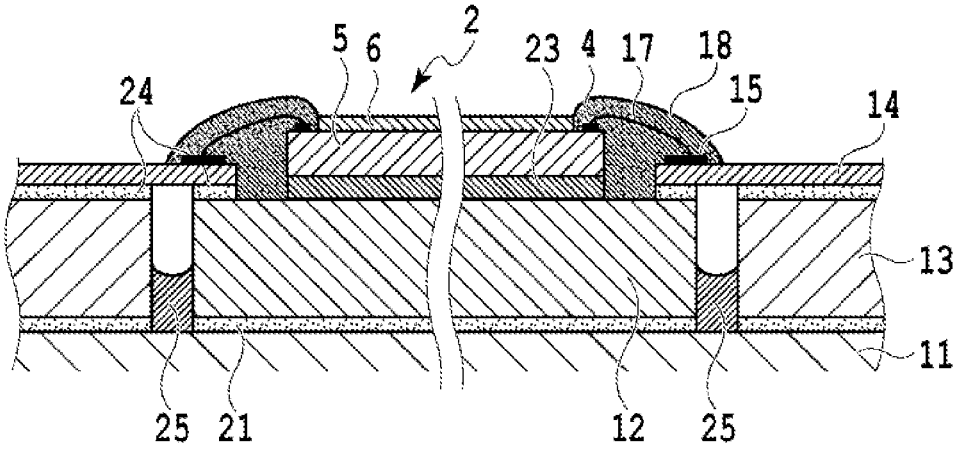
FIGS. 6A and 6B are views illustrating the details of the configuration in the vicinity of one printing element substrate in a liquid ejection head according to another modification of the first embodiment of the present invention.
Figure 6B:
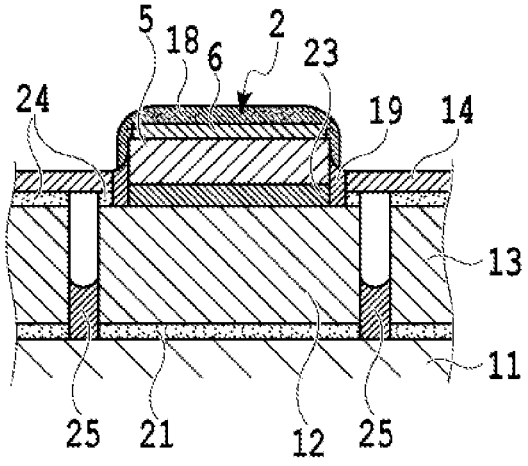

FIGS. 6A and 6B are the views illustrating the details of the configuration in the vicinity of one printing element substrate in a liquid ejection head according to another modification in the first embodiment of the present invention. FIG. 6A is the view corresponding to the schematic cross sectional view along the B-B line of FIG. 5A, and FIG. 6B is the view corresponding to the schematic cross sectional view along the C-C line of FIG. 5A. In the modification, portions between the frame member 13 and the support member 12 are sealed with a second sealing agent 25. This can improve the sealing between the support substrate 11 and the support member 12, and thus prevent a liquid from leaking due to an unexpected accident. A material whose modulus of elasticity is relatively low is preferably used for the second sealing agent 25. Thus, a stress in curing and contracting can be reduced to suppress the position variation of the support member 12. Also in the modification, the position variation of the printing element substrate can be suppressed and the variation in sealing height can be reduced, and a more reliable liquid ejection head can be provided.

Figure 7A:
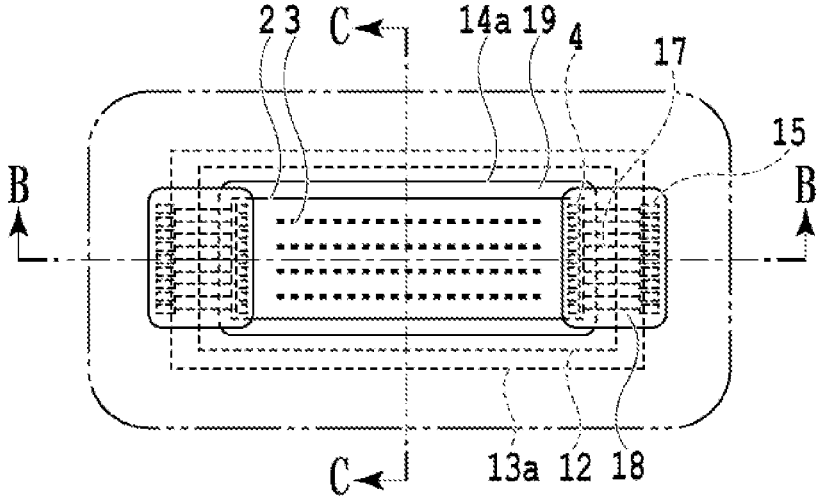
FIGS. 7A and 7B are views illustrating the details of the configuration in the vicinity of one printing element substrate in a liquid ejection head according to yet another modification of the first embodiment of the present invention.
Figure 7B:
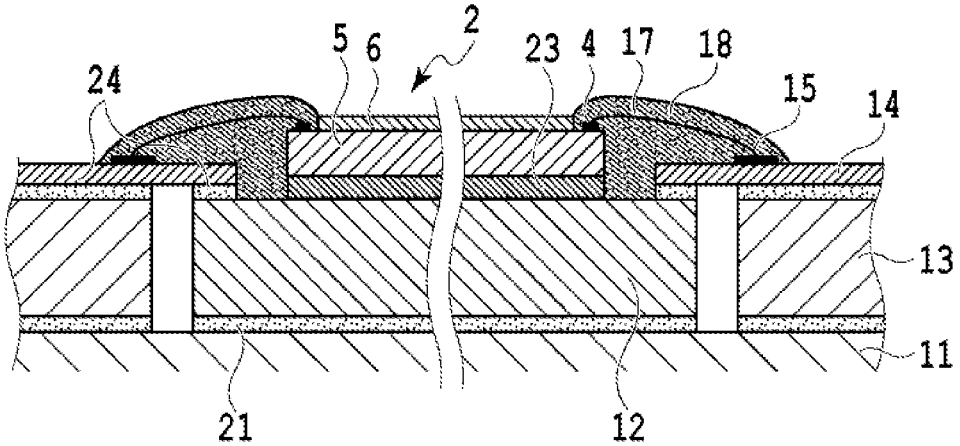

FIGS. 7A and 7B are the views illustrating the details of the configuration in the vicinity of one printing element substrate in a liquid ejection head according to yet another modification of the first embodiment of the present invention. FIG. 7A is a plan view enlarging and illustrating the vicinity of the printing element substrate, and FIG. 7B is the schematic cross sectional view along the B-B line of FIG. 7A. In the modification, the bonding portion between the electrode terminal 15 and the wire 17 is positioned above the frame member 13. In the case where a material having a high rigidity like aluminum oxide is used for the frame member 13, bondability may become higher than the bondability in the case where bonding is performed above the support member 12. Thus, electrical bonding failures can be reduced and the manufacturing yield can be improved. Moreover, durability and reliability can be improved. Also in the modification, the position variation of the printing element substrate can be suppressed and the variation in sealing height can be reduced, and furthermore a liquid ejection head with a higher yield and higher durability and reliability can be constructed.

Second Embodiment

Figure 8A:
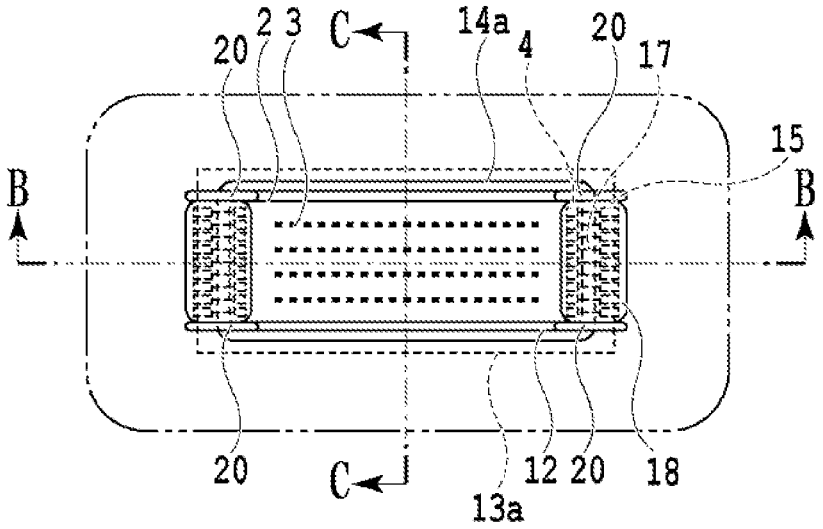
FIGS. 8A to 8C are views illustrating the configuration in the vicinity of a printing element substrate of a liquid ejection head according to a second embodiment of the present invention.
Figure 8B:
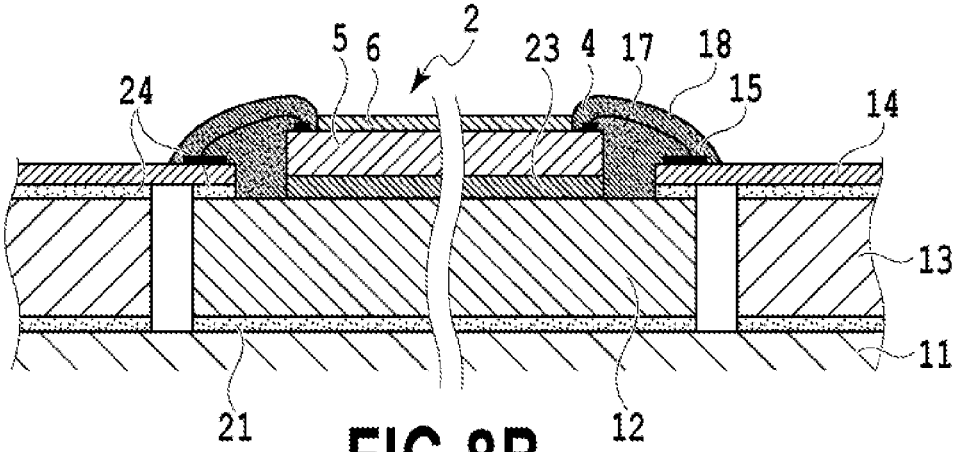
Figure 8C:
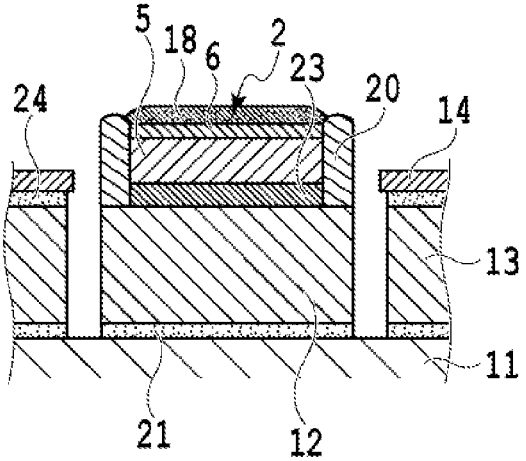

FIGS. 8A to 8C are the views illustrating the configuration in the vicinity of a printing element substrate of a liquid ejection head according to a second embodiment of the present invention. Specifically, FIG. 8A is a plan view enlarging and illustrating the vicinity of the printing element substrate, FIG. 8B is the schematic cross sectional view along the B-B line of FIG. 8A, and FIG. 8C is the schematic cross sectional view along the C-C line of FIG. 8A. Note that the liquid ejection head of the embodiment is configured as with the liquid ejection head according to the modification of the first embodiment, except the configuration illustrated below.

Also in the embodiment, as with the modification of the first embodiment, most part of the electrical wiring substrates 14 is bonded and fixed onto the frame member 13, but in the outer periphery of the opening 14*a*, only a region in which the electrical connecting portion is provided is arranged above the support member 12 and bonded and fixed thereto. Accordingly, the cross sectional view illustrated in FIG. 8B is the same as that of FIG. 5B, but in the cross sectional view of FIG. 8C, the electrical wiring substrate 14 is arranged only on the frame member 13. Thus, the width of the support member 12 can be reduced and the head width (the width of the head corresponding to the short-length direction of the printing element substrate) can be also reduced. As the head width decreases, the pitch between the heads can be also reduced and the printing apparatus body can be made compact in the case where a plurality of heads is arranged side by side. Moreover, because the deviation in the landing position of ejection liquid droplets between the heads due to the variations in conveyance accuracy of the printing medium can be also reduced, better image quality can be obtained.

In the embodiment, by applying the first sealing agent 18 after forming a dam agent 20 at the four corners of the printing element substrate 2, the first sealing agent 18 is prevented from flowing in between the frame member 13 and the support member 12. That is, in the outer periphery of the opening of the electrical wiring substrate 14, the dam agent is provided in the boundary between the electrical connecting portion and the non-electrical connecting portion. A material having a higher viscosity and a higher shape retentivity is preferably used for the dam agent 20. Moreover, the sealing agent 19 used in the first embodiment is not used. In the case where the sealing between the printing element substrate 2 and the support member 12 is sufficient, the sealing agent 19 can be omitted.

Also in this embodiment, because the electrical wiring substrate 14 is bonded and fixed to the frame member, expansion and contraction of the electrical wiring substrate 14 can be suppressed and the variation in the mounting position of the printing element substrate can be suppressed. Furthermore, by forming the dam agent 20, the inflow of the first sealing agent 18 can be prevented, the shape of the first sealing agent 18 and the curing contraction stress thereof can be made uniform regardless of the positions, the positional accuracy in mounting the printing element substrate can be improved, and the variation in sealing height can be suppressed. Accordingly, a liquid ejection head enabling an improvement in image quality and high-speed printing can be provided.

Third Embodiment

Figure 9A:
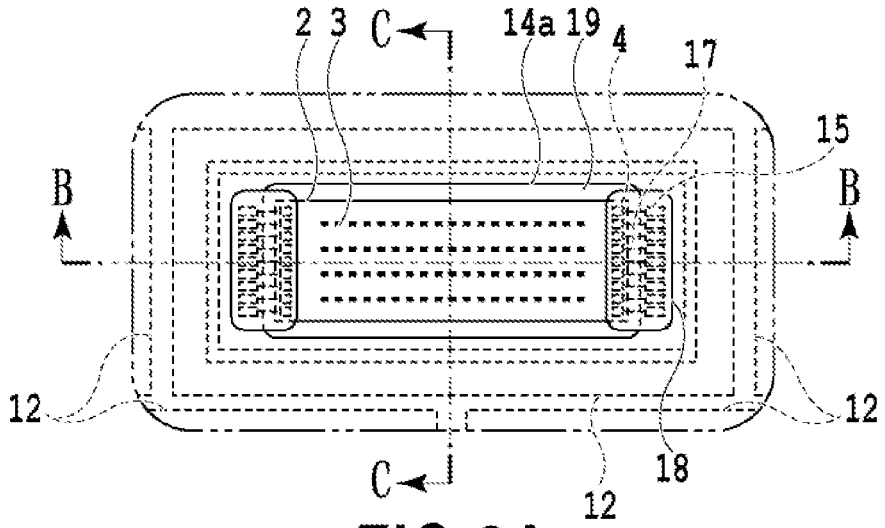
FIGS. 9A to 9C are views illustrating the configuration in the vicinity of a printing element substrate of a liquid ejection head according to a third embodiment of the present invention.
Figure 9B:
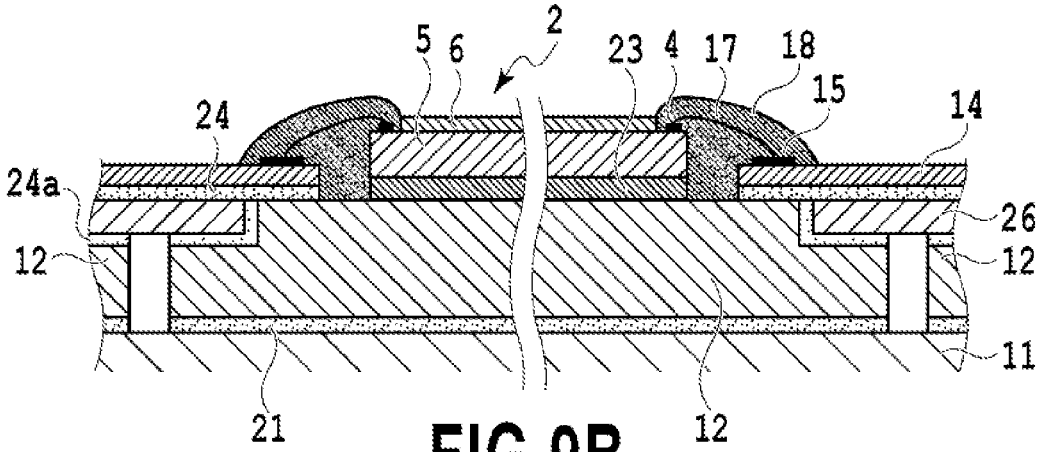
Figure 9C:
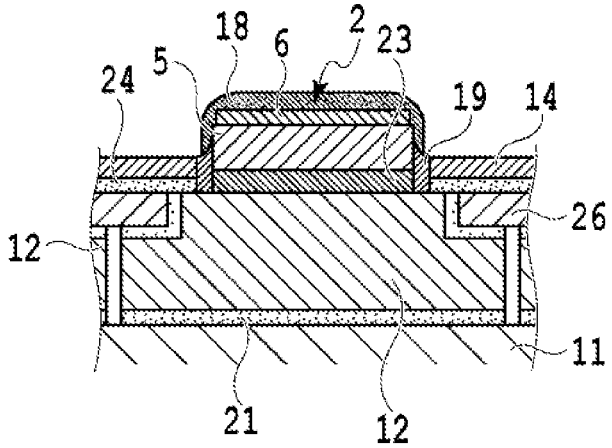

FIGS. 9A to 9C are the views illustrating the configuration in the vicinity of a printing element substrate of a liquid ejection head according to a third embodiment of the present invention. Specifically, FIG. 9A is a plan view enlarging and illustrating the vicinity of the printing element substrate, FIG. 9B is the schematic cross sectional view along the B-B line of FIG. 9A, and FIG. 9C is the schematic cross sectional view along the C-C line of FIG. 9A.

In this embodiment, a plate member 26 is arranged on the support member 12. The plate member 26 and the support member 12 are bonded and fixed to each other with an adhesive agent 24*a*. The upper surface of the plate member 26 and the uppermost surface of the support member 12 are set at substantially the same height. The electrical wiring substrate 14 is arranged so as to be extended over space between the plate member 26 and the support member 12, and is bonded and fixed thereto with the adhesive agent 24. Thus, the gap between the support members 12 can be covered with the electrical wiring substrate 14.

The same material as the frame member can be used for the material of the plate member. In the case where the frame member is prepared using aluminum oxide, the frame member becomes thick and therefore the manufacturing becomes difficult and an expensive manufacturing method often has to be selected. However, the plate member of the embodiment can be made thinner due to the head configuration, can be prepared at a relatively inexpensive manufacturing cost, and the component cost can be reduced.

Also in this embodiment, the positional accuracy in mounting the printing element substrate can be improved, and accordingly, a liquid ejection head enabling an improvement in image quality and high-speed printing can be provided.

According to each of the above embodiments, by precisely mounting the individual support member on the support substrate, the relative positional accuracy between a plurality of supply ports can be ensured, and a liquid ejection head capable of improving the liquid suppliability can be provided.

Moreover, by using a collective electrical wiring substrate, it is possible to combine wirings corresponding to a plurality of printing element substrates, reduce the number of wirings, and route the wirings corresponding to the sizes of various printing element substrates. Because the wiring width of a power supply system can be also increased, a liquid ejection head can be provided, in which the amount of voltage drop can be reduced and with which a stable drive can be performed even in the case where high speed printing is achieved.

Furthermore, collective capping with recovery caps is enabled, and the configuration of a recovery system can be simplified, and a reduction in size of the printing apparatus can be achieved. A liquid ejection head capable of improving the wiping performance by means of a blade and capable of suppressing an image defect can be provided.

Furthermore, because the electrical wiring substrate is constrained by the frame member and/or plate member having a lower linear expansion coefficient, the variation in the mounting position of the printing element substrate via the first sealing agent caused by the expansion and contraction of the electrical wiring substrate due to heating and cooling during the manufacturing processes and the like can be suppressed. The electrical wiring substrate is mounted so as to be extended over a space between the support member and the frame member (plate member), and therefore even in the case where the gap between the support member and the frame member (plate member) varies due to the variations in size and/or in assembly, the shape of the first sealing agent of the electrical connecting portion is substantially uniform regardless of the positions. Accordingly, the stress in curing and contracting of the first sealing agent becomes substantially uniform, the positional accuracy in mounting the printing element substrate is improved, and the variation in sealing height is reduced, so that the distance between the ejection port surface of the printing element substrate and the printing medium can be reduced. Accordingly, image quality can be improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-153811, filed Jul. 24, 2013, which is hereby incorporated by reference herein in its entirety.

What is claimed is:

1. A liquid ejection head comprising:

a printing element substrate on which an ejection port for ejecting liquid is provided;

a support member supporting the printing element substrate;

another member arranged to be separated from the support member by a gap;

an electrical wiring substrate that is provided to be extended over the support member and the other member and covers the gap; and an electrical connecting portion having a wiring to electrically connect with the printing element substrate, wherein the electrical connecting portion is sealed with a sealing agent.

2. The liquid ejection head according to claim 1, wherein the other member is a frame member having an opening in which the support member is arranged.

3. The liquid ejection head according to claim 2, wherein the frame member has lower linear expansion coefficient than that of the electrical wiring substrate.

4. The liquid ejection head according to claim 2, wherein respective surfaces of the support member and the frame member on which the electrical wiring substrate is provided have substantially the same height.

5. The liquid ejection head according to claim 2, wherein the gap between the support member and the frame member is sealed with a second sealing agent.

6. The liquid ejection head according to claim 1, wherein the electrical wiring substrate has an opening in which the printing element substrate is arranged and a whole outer periphery of the opening is arranged on the support member.

7. The liquid ejection head according to claim 1, wherein the electrical wiring substrate has an opening in which the printing element substrate is arranged and only a region of an outer periphery of the opening in which the electrical connecting portion is provided is arranged above the support member.

8. The liquid ejection head according to claim 7, wherein a dam agent is provided in a boundary between the electrical connecting portion and a non-electrical connecting portion in the outer periphery of the opening of the electrical wiring substrate.

9. The liquid ejection head according to claim 1, wherein the other member is a support member supporting another printing element substrate and a plate member having an opening in which the printing element substrate is arranged is provided on a part of two support members, the electrical wiring substrate being extended over a space between the two support members.

10. The liquid ejection head according to claim 9, wherein the plate member has lower linear expansion coefficient than that of the electrical wiring substrate.

11. The liquid ejection head according to claim 9, wherein respective surfaces of the support member and the plate member on which the electrical wiring substrate is provided have substantially the same height.

12. The liquid ejection head according to claim 1, wherein a plurality of printing element substrates are provided.

13. The liquid ejection head according to claim 12, wherein the plurality of printing element substrates is arranged in a staggered form in a predetermined direction.

14. A liquid ejection apparatus that uses a liquid ejection head so as to cause the liquid ejection head to eject liquid, the liquid ejection head comprising:

a printing element substrate on which an ejection port for ejecting liquid is provided;

a support member supporting the printing element substrate;

another member arranged to be separated from the support member by a gap;

an electrical wiring substrate that is provided to be extended over the support member and the other member and covers the gap; and an electrical connecting portion having a wiring to electrically connect with the printing element substrate, wherein the electrical connecting portion is sealed with a sealing agent.

* * * * *